US005237381A

United States Patent [19]

Hamada

[11] Patent Number: 5,237,381

[45] Date of Patent: Aug. 17, 1993

[54] SHEET DISCHARGING APPARATUS WITH CURL CORRECTING MEANS

[75] Inventor: Tatsuo Hamada, Tokyo, Japan

[73] Assignee: Canon Kabushiki Kaisha, Tokyo, Japan

[21] Appl. No.: 823,462

[22] Filed: Jan. 22, 1992

[30] Foreign Application Priority Data

Jan. 23, 1991 [JP] Japan ..... 3-22874

[51] Int. Cl.[5] ..... G03G 15/00

[52] U.S. Cl. ..... 355/321; 271/188; 271/184; 271/303; 162/197; 162/271; 355/309

[58] Field of Search ..... 355/309, 308, 318, 320, 355/321, 282, 285, 290; 271/303, 184, 186, 186, 188, 16, 19, 161, 209; 162/197, 271

[56] References Cited

U.S. PATENT DOCUMENTS

| | | | |
|---|---|---|---|
| 4,013,284 | 3/1977 | Demetre | 162/271 X |
| 4,326,915 | 4/1982 | Mutschler | 162/271 |
| 4,571,054 | 2/1986 | Bowler . | |
| 4,627,718 | 12/1986 | Wyer | 162/271 X |
| 4,632,533 | 12/1986 | Young . | |
| 4,639,405 | 1/1987 | Franke | 430/124 |
| 4,652,110 | 3/1987 | Sato et al. | 162/271 X |
| 4,750,016 | 6/1988 | Kusumoto et al. . | |
| 4,926,358 | 5/1990 | Tani et al. | 355/311 X |
| 4,945,390 | 7/1990 | Hasegawa et al. . | |
| 5,066,984 | 11/1991 | Coombs | 355/309 |
| 5,084,731 | 1/1992 | Baruch | 355/208 |

FOREIGN PATENT DOCUMENTS

| | | |
|---|---|---|
| 0346934 | 12/1989 | European Pat. Off. . |
| 0372479 | 6/1990 | European Pat. Off. . |
| 60-50547 | 3/1985 | Japan . |
| 61-75369 | 4/1986 | Japan . |

OTHER PUBLICATIONS

Abstract of Japanese Kokai Application 2-273773 Published Nov. 1990.
Abstract of Japanese Kokai Application 2-293772 Published Dec. 1990.
Abstract of Japanese Kokai Application 2-277089 Published Nov. 1990.
Abstract of Japanese Kokai Application 1-316777 Published Dec. 1989.
Abstract of Japanese Kokai Application 62-150276 Published Jul. 1987.
Abstract of Japanese Kokai Application 62-287266 Published Dec. 1987.
Abstract of Japanese Kokai Application 60-260964 Published Dec. 1985.
Abstract of Japanese Kokai Application 3-120572 Published May 1991.
Abstract of Japanese Kokai Application 1-251070 Published Oct. 1989.
Abstract of Japanese Kokai Application 60-100164 Published Jun. 1985.
Abstract of Japanese Kokai Application 3-100688 Published Apr. 1991.
Abstract of Japanese Kokai Application 2-277088 Published Nov. 1990.
Abstract of Japanese Kokai Application 52-47737 Published Apr. 1977.
Abstract of Japanese Kokai Application 63-313182 Published Dec. 21, 1988.

*Primary Examiner*—R. L. Moses
*Attorney, Agent, or Firm*—Fitzpatrick, Cella, Harper & Scinto

[57] ABSTRACT

A sheet discharging apparatus having a curl generating device wherein a curl is generated in a sheet while the sheet is passing through the curl generating device, and a first guide disposed downstream of the curl generating device and switchingly movable between a first position where the sheet is directed toward a curved sheet path and a second position where the sheet is directed toward a direction the same as a sheet feeding direction from the curl generating device. The apparatus further has a sheet discharge guide disposed between the curl generating device and the first guide and switchingly movable in synchronism with the switching movement of the first guide to change its posture, between a position where the sheet discharged from the curl generating device is curled reversely and a position where the sheet discharged from the curl generating device is not further curled.

18 Claims, 12 Drawing Sheets

FIG. 4

OCCURRENCE OF CURL AT EACH PORTION

| | SHEET DISCHARGE GUIDE ANGLE | CURL GENERATED AT NIP | CURL GENERATED AT SHEET DISCHARGE GUIDE | CURL GENERATED AT SHEET DISCHARGE PATH | SUM OF CURL |
|---|---|---|---|---|---|
| FACE-UP SHEET DISCHARGE | LARGE | ↑ | ↓ | ↑ | ↕ |
| FACE-DOWN SHEET DISCHARGE | SMALL | ↑ | ↕ | ↓ | ↕ |

FIG. 11
PRIOR ART

OCCURRENCE OF CURL AT EACH PORTION

| | | CURL GENERATED AT FIXING NIP | CURL GENERATED AT SHEET DISCHARGE GUIDE | CURL GENERATED AT SHEET DISCHARGE PATH | SUM OF CURL |
|---|---|---|---|---|---|
| SHEET DISCHARGE ANGLE IS LARGE | FACE-UP SHEET DISCHARGE | ↷ | ↶ | ↕ | ↕ |
| | FACE-DOWN SHEET DISCHARGE | ↶ | ↶ | ↷ | ↶ |
| SHEET DISCHARGE ANGLE IS SMALL | FACE-UP SHEET DISCHARGE | ↶ | ↕ | ↕ | ↷ |
| | FACE-DOWN SHEET DISCHARGE | ↷ | ↕ | ↶ | ↕ |

SHEET DISCHARGING APPARATUS WITH CURL CORRECTING MEANS

BACKGROUND OF THE INVENTION

1. Field of the Invention

The present invention relates to a sheet ejecting or discharging apparatus having a curl correcting means, and more particularly, it relates to a sheet discharging apparatus used with an electrophotographic system such as a copying machine, laser beam printer and the like. More specifically, the present invention relates to a sheet discharging apparatus wherein the curl generated in a sheet at a fixing station is corrected by a curl correcting mechanism and then the sheet is discharged or ejected in a face-up or face-down mode.

2. Related Background Art

As shown in FIG. 7, a conventional fixing device includes a fixing roller 30 comprising a metallic pipe for fusing and fixing a toner image on a transfer sheet by utilizing heat generated by means of a halogen heater 31, and an elastic pressure roller 32 urged against the fixing roller 30 by means of a pressure spring 33. However, in such a fixing device, when the image formation is to be started with the printer completely cooled, it is necessary that the halogen heater 31 is energized for a long time to perform a warming-up operation for adequately heating the fixing roller 30. Consequently, it takes a long time the image formation permissible condition to be established after turning on of the power source, and a large amount of electric power is consumed.

Thus, in place of the fixing roller 30 and the halogen heater 31, as shown in FIG. 8, there has been proposed a fixing system comprising a fixedly supported flat plate-shaped ceramic heater 35, a heat-resisting film 36 shiftable while contacting with the heater 35, and a pressure roller 37 for urging a transfer sheet P against the heater 35 via the film 36 (refer to Japanese Patent Laid-open No. 63-313182). More specifically, as shown in FIG. 9, the heat-resisting film 36 is held for rotation around a guide member 39. The elastic pressure roller 37 is disposed in confronting relation to the ceramic heater 35 and is urged against the heater with the interposition of the film 36 therebetween by means of a compression spring 40. In such a fixing system, even if the whole fixing system is completely cooled, since the transfer sheet P is urged against the heater 35 with the interposition of the thin film 36 having a thickness of several tenth microns, the warming-up time can be considerably reduced and thus, the consumption of the electric power can also be reduced greatly.

Incidentally, in the fixing system of FIG. 8, as shown in FIG. 9, immediately before the film 36 enters into a fixing nip between the rollers, the film is slightly tensioned by means of a projection 41*a* integrally formed on a heater holder 41 in the proximity of the heater 35 at an upstream side thereof, so that wrinkles and irregularities in the film are removed to form a stable flat nip portion as indicated by D. However, as shown in FIG. 8, with this arrangement, since the pressure at a central portion B in the nip is slightly greater than those at upstream and donwstream portions A, C, the transfer sheet P is curved to form a downwardly directed concave portion.

If the transfer sheet with the downwardly directed concave portion (generated at the nip portion) is heated by the heater 35 and then is subjected to natural cooling, a great downwardly directed concave curl is generated in the transfer sheet, as shown by the portion D in FIG. 9. To avoid this, as shown in FIG. 10, before the transfer sheet P is subjected to the natural cooling, the transfer sheet P with the downwardly directed concave portion (generated at the fixing nip portion D) is forcibly curved upwardly by providing a sheet discharge guide 42 extending leftwardly and upwardly from the downstream side of the pressure roller 37, as shown by a portion E in FIG. 9. Then, by cooling the transfer sheet P naturally, the curl in the sheet is surpressed.

The transfer sheet P that the curl is corrected as mentioned above is suited for an electrophotographic system having a sheet discharging apparatus for discharging a sheet in a face-up manner. However, when the sheet is discharged in a face-down manner from the fixing device, there arises a problem that the sheet is again curled upwardly at an inverting portion 43 (portion F) (refer to FIG. 11). To avoid this, a radius of curvature of the inverting portion 43 shown in FIG. 10 may be increased, or the transfer sheet P may be forcibly cooled by using a fan and the like, or a distance between the fixing device and the inverting portion 43 may be increased so as to permit the adequate cooling of the sheet. However, these techniques will make the compactness and cost-down of the laser beam printer and the like difficult.

SUMMARY OF THE INVENTION

The present invention aims to eliminate the above-mentioned conventional drawbacks, and an object of the present invention is to provide a sheet discharging apparatus having a curl correcting means which can discharge or eject a sheet with less curl.

In order to achieve the above object, according to the present invention, there is provided a sheet discharging apparatus having a curl correcting means wherein a sheet discharge guide driven in synchronous with a guide member to correct the curl generated in a sheet at a curl generating means is disposed between the curl generating means and the guide member.

According to one aspect of the present invention, a sheet discharging apparatus comprises a fixing device (curl generating means) for fixing an image transferred to a transfer sheet with heat and pressure, and a guide member disposed at a downstream side of the fixing device and pivotable between a first position where the transfer sheet is guided toward a discharging direction of the fixing device and a second position where the transfer sheet is guided to be inverted from the discharging direction of the fixing device, and further comprises a sheet discharge guide diposed between the fixing device and the guide member and driven in synchronous with the guide member to correct the curl generated in the transfer sheet at the fixing device.

Further, the fixing device and the sheet discharge guide are constructed and arranged so that a downwardly directed curl is generated in the transfer sheet by the fixing device and an upwardly directed curl is generated in the transfer sheet by the sheet discharge guide driven in synchronous with the guide member positioned in the first position without generating the curl in the transfer sheet by the sheet discharge guide driven synchronous with the guide member positioned in the second position.

With this arrangement, after the image is fixed to the transfer sheet by the fixing device with heat and pressure, the transfer sheet is discharged toward the discharging direction of the fixing device at the first position of the guide member, and then the transfer sheet is inverted from the discharging direction of the fixing device at the second position of the guide member, thus ejecting the sheet. In this case, by driving the sheet discharge guide in synchronous with the guide member, the curl generated in the transfer sheet at the fixing device is corrected, thereby permitting the discharge of the transfer sheet with less curl. Further, the downwardly directed curl is geneated in the transfer sheet by the fixing device and the upwardly directed curl is generated in the transfer sheet by the sheet discharge guide driven in synchronous with the guide member positioned in the first position; but the curl is not generated in the transfer sheet by the sheet discharge guide driven synchronous with the guide member positioned in the second position.

As mentioned above, according to the present invention, since the sheet discharge guide driven in synchronous with the guide member to correct the curl generated in the transfer sheet at the curl generating means is disposed between the guide member and the curl generating means, it is possible to minimize the curl in the sheet on which the image was formed and which is to be discharged, with a simple construction.

BRIEF DESCRIPTION OF THE DRAWINGS

FIG. 4 is a view for explaining the occurrence of curl at various portions of the apparatus according to the preferred embodiment;

FIG. 11 is a view for explaining the occurrence of curl at various portions in dependence upon angles of a sheet discharge guide.

DESCRIPTION OF THE PREFERRED EMBODIMENTS

The present invention will now be explained in connection with embodiments thereof with reference to the accompanying drawings.

Figure 1:
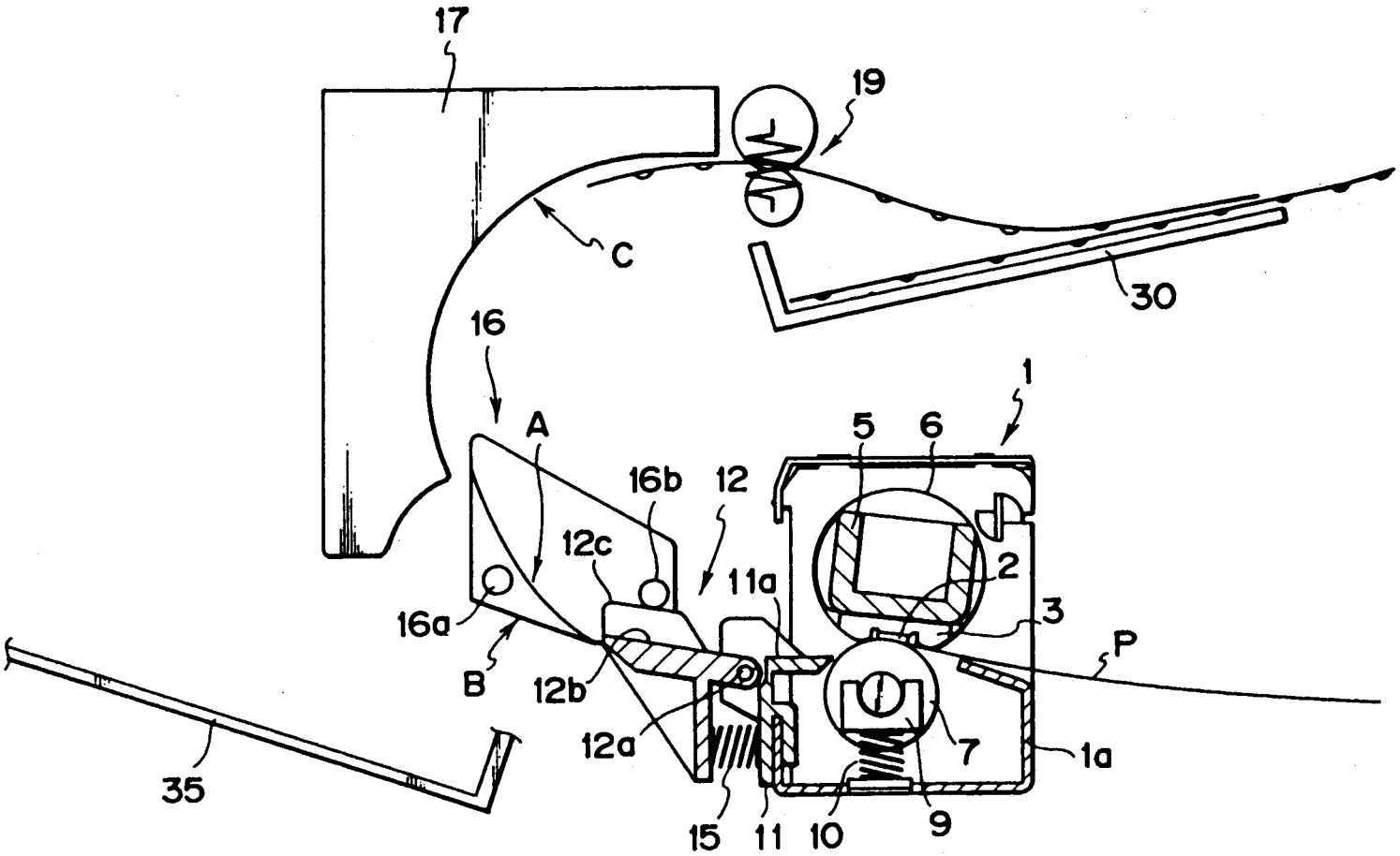
FIG. 1 is an elevational sectional view of a sheet discharging apparatus according to a preferred embodiment of the present invention, showing a facedown sheet discharging condition.

In FIG. 1, a fixing device 1 has a body frame 1*a* within which a ceramic heater 2 acting as a heat source is supported by a fixed support member 5 via a holder 3. A heat-resisting fixing film 6 is disposed around the support member 5 for rotation therearound. An elastic pressure roller 7 is urged against the heater 2 with the interposition of the film 6 therebetween, by means of a pressure spring 10 via a spring receiver 9.

Figure 2:
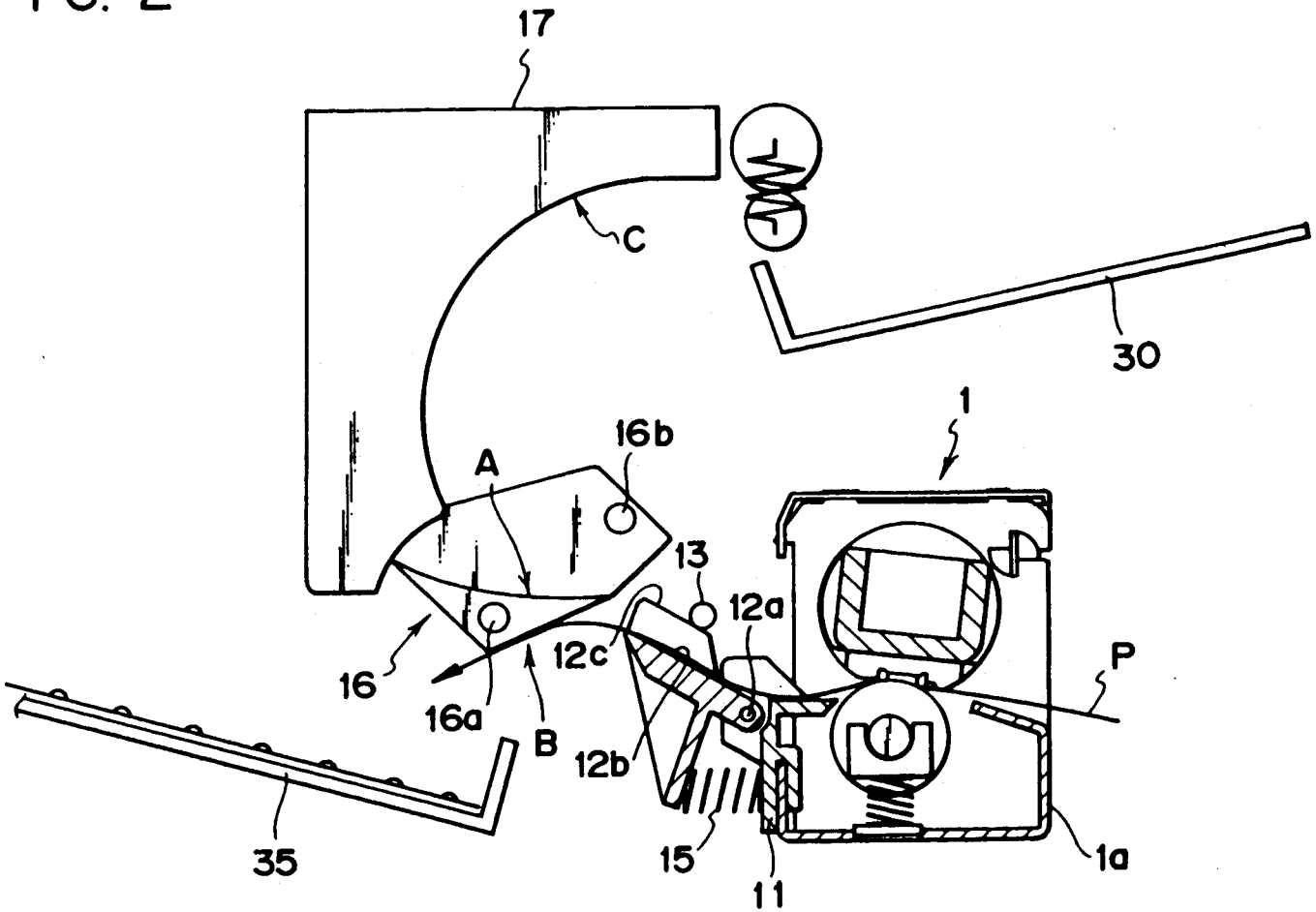
FIG. 2 is an elevational sectional view similar to FIG. 1, but showing a face-up sheet discharging condition.

Further, a separating guide 11 having a horizontal upper surface 11*a* is secured to the body frame 1*a* and serves to prevent a sheet P from wrapping around the pressure roller 7. A sheet discharge guide 12 is pivotally mounted on the separating guide 11 via pins 12*a* formed on both ends of the sheet discharge guide, so that a guide surface 12*a* of the sheet discharge guide is contiguous to the upper surface 11*a* of the separating guide 11. As shown in FIG. 2, ribs 12*c* formed on both lateral edges of the upper surface of the sheet discharge guide are locked against fixed stoppers 13 to limit the upward rocking movement of the sheet discharge guide 12.

Incidentally, a compression spring 15 disposed between a lower portion of the sheet discharge guide 12 and the separating guide 11 serves to bias the sheet discharge guide 12 in a clockwise direction. Further, a flapper 16 serving as the first guide means is rotatably supported on a pivot shaft 16*a* at a downstream side of the sheet discharge guide 12. The flapper has an upwardly directed concave upper surface A and a substantially flat lower surface B. Further, stoppers 16*b* are secured to ribs formed on both lateral edges of the flapper, which stoppers can be engaged by the ribs 12*c* formed on the sheet discharge guide 12. In addition, a rib 17 formed on a wall of a sheet discharging portion defines an inwardly directed concave sheet discharge path C at its free end, and a sheet discharge roller 19 is disposed in the vicinity of the exit of the sheet discharge path C.

Next, a sheet discharging operation will be explained. First of all, a face-down sheet discharging operation will be described.

Figure 3:
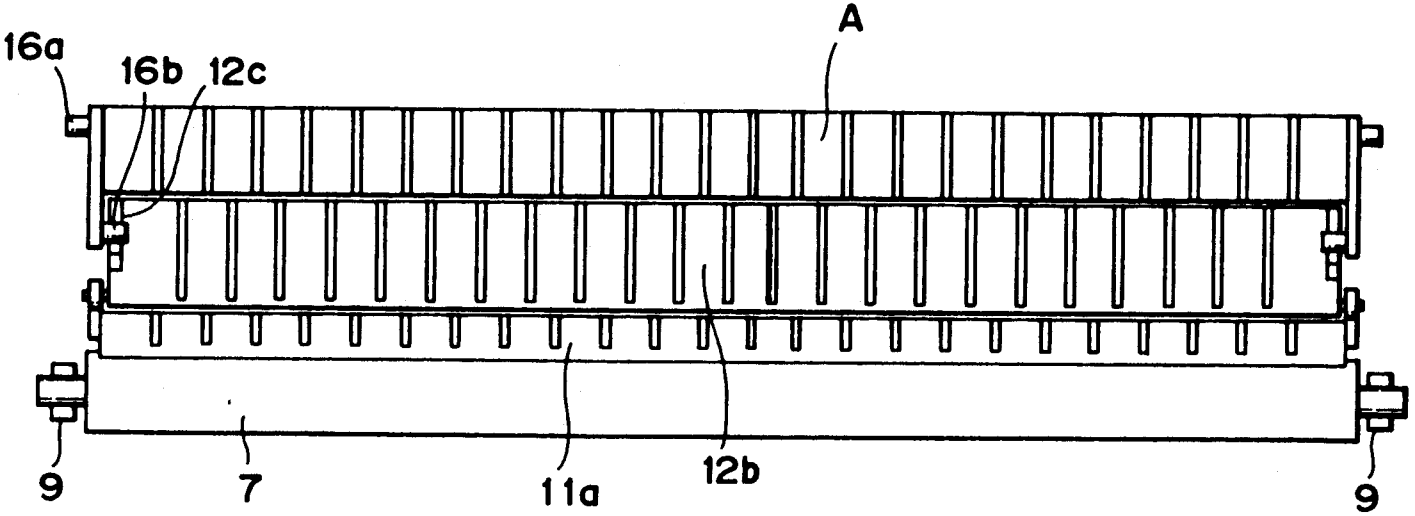
FIG. 3 is a plan view of a portion of the apparatus of FIG. 1.

When the flapper 16 is rotated in the clockwise direction (FIGS. 1 and 2) by means of an external operation lever (not shown) or by means of a drive means (not shown) operated in response to a face-down sheet discharge signal, the stoppers 16*b* are engaged by the ribs 12*c* of the sheet discharge guide 12 to lower the discharge guide 12 in opposition to a biasing force of the compression spring 15. When the upper surface A of the flapper 16 is substantially aligned with the sheet discharge path C, the inclination of the guide surface 12*b* of the sheet discharge guide 12 is decreased (FIG. 1) so as to align the guide surface 12*b* with the upper surface A of the flapper 16. In this condition, a downstream end of the upper surface 11*a* of the separating guide 11 is slightly higher than an upstream end of the guide surface 12*b* and a downstream end of the guide surface 12*b* is slightly higher than an upstream end of the surface A and a downstream end of the surface A is slightly inner more than an upstream end of the sheet discharge path C, so that the sheet P being fed is not caught by these elements. FIG. 3 is a plan view showing the arrangement of these elements.

A downwardly directed curl generated in the sheet P at a fixing nip portion between the fixing roller and the pressure roller is not corrected by the guide surface 12*b* of the sheet discharge guide 12; but, this curl is cancelled by an upwardly directed curl generated in the sheet at the sheet discharge path C, with the result that the curl remaining in the sheet P discharged onto a tray 30 via the sheet discharge roller 19 will become smaller. Therefore, according to this embodiment, it is possible to omit a curl removing roller which was required in association with the sheet discharge roller in the conventional sheet discharging apparatus.

Next, a face-up sheet discharging operation will be described.

When the flapper 16 is rotated around the pivot shaft 16a in an anti-clockwise direction (FIG. 1) by means of the operation lever or the drive means until the lower surface B of the flapper is inclined rightwardly and upwardly by about 30 degrees, the stoppers 16b are disengaged from the guide surface 12b of the sheet discharge guide 12. The sheet discharge guide 12 is rotated around the pins 12a in the clockwise direction by the biasing force of the compression spring 15 until the ribs 12c are abutted against the fixed stoppers 13.

In this way, since the guide surface 12b of the sheet discharge guide 12 is inclined leftwardly and upwardly by about 40 degrees, the downwardly directed curl generated in the sheet P at the fixing nip portion is substantially cancelled by an upwardly directed curl generated in the sheet at the guide surface 12b. Then, the sheet P is passed below the lower surface B of the flapper 16 and is discharged on a sheet discharge tray 35, with less curl (FIG. 2).

The above-mentioned sheet discharging conditions are shown in FIG. 4.

Figure 5A:
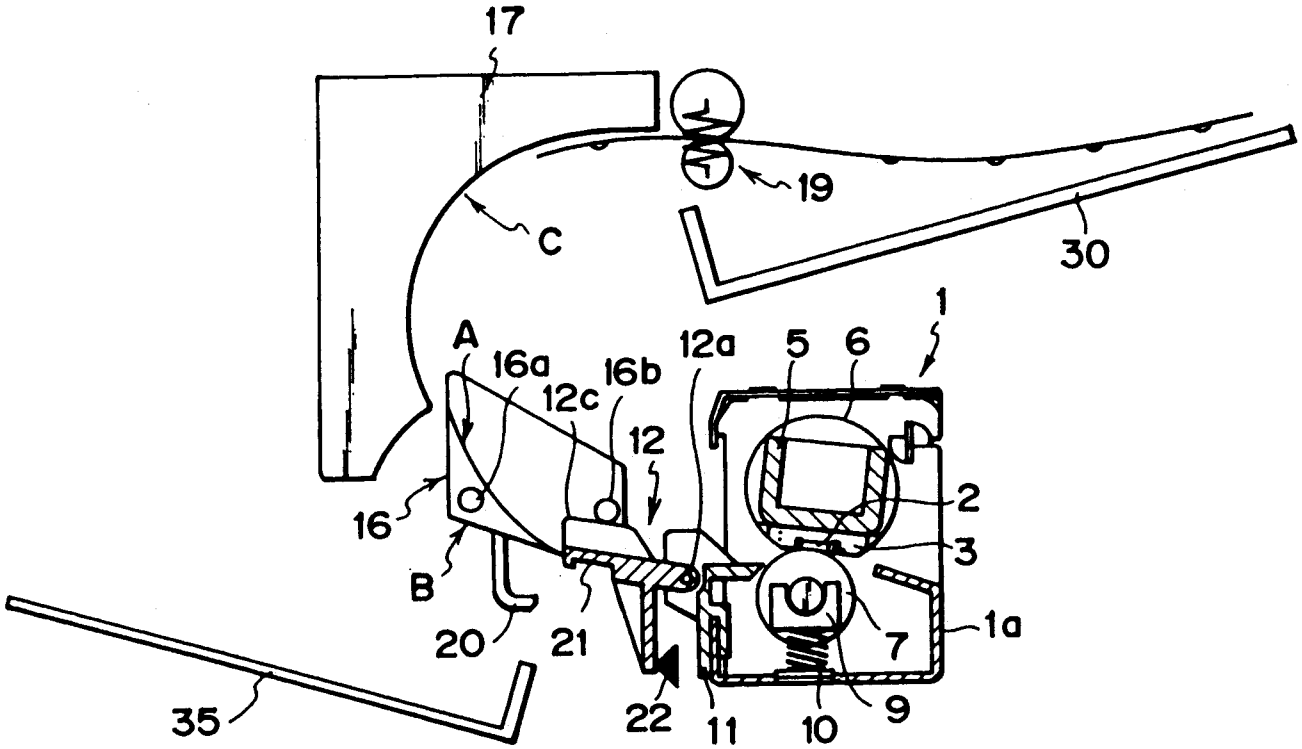
FIGS. 5A, and 5B are elevational sectional views of a sheet discharging apparatus according to another embodiment of the present invention.
Figure 5B:
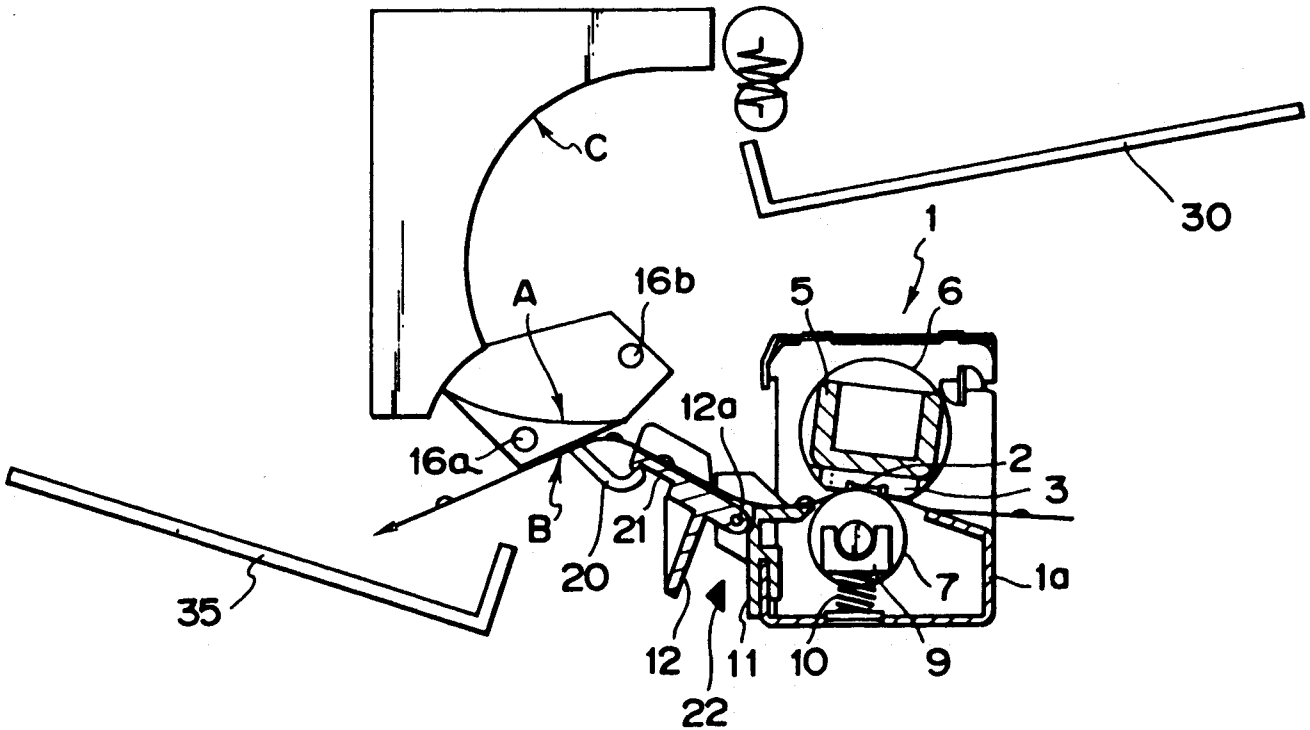

Next, a second embodiment of the present invention will be explained with reference to FIGS. 5A and 5B.

The same structural elements as those in the first embodiment shown in FIGS. 1 and 2 are designated by the same reference numerals and the detailed explanation thereof will be omitted. In this second embodiment, in place of the compression spring 15 and the stoppers 13 (FIGS. 1 and 2), a hooked arm 20 extending downwardly is formed on the lower surface B of the flapper 16, and a recess 21 for receiving a hooked end of the arm 20 is formed in the lower surface of the sheet discharge guide 12. Further, there is provided a stopper 22 against which the sheet discharge guide 12 is abutted when the latter is substantially in a horizontal position (FIG. 5A) for the face-down sheet discharge.

With this arrangement, in the face-down sheet discharging operation (FIG. 5A), the sheet discharge guide 12 is abutted against the stopper 22 by its own weight, with the result that the flapper 16 is so positioned that the stoppers 16b of the flapper 16 are rested on or abutted against the ribs 12c of the sheet discharge guide 12. On the other hand, in the face-up sheet discharging operation (FIG. 5B), when the flapper 16 is rotated in the anti-clockwise direction, the hooked end of the arm 20 is engaged by the recess 21 of the sheet discharge guide 12, thereby rotating the latter in the clockwise direction, with the result that the flapper 16 and the sheet discharge guide 12 are positioned in the face-up sheet discharging positions, respectively.

The technical effects or advantages obtained by this second embodiment are the same as those obtained by the above-mentioned first embodiment.

Figure 6A:
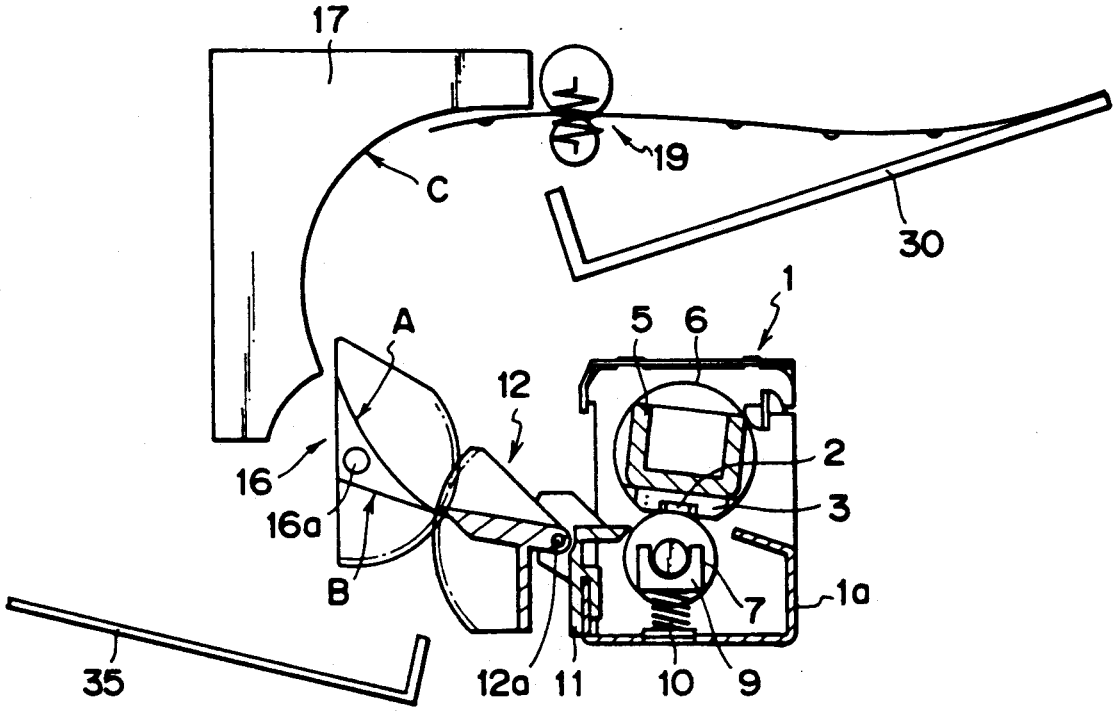
FIGS. 6A and 6B are elevational sectional views of a sheet discharging apparatus according to a further embodiment of the present invention.
Figure 6B:
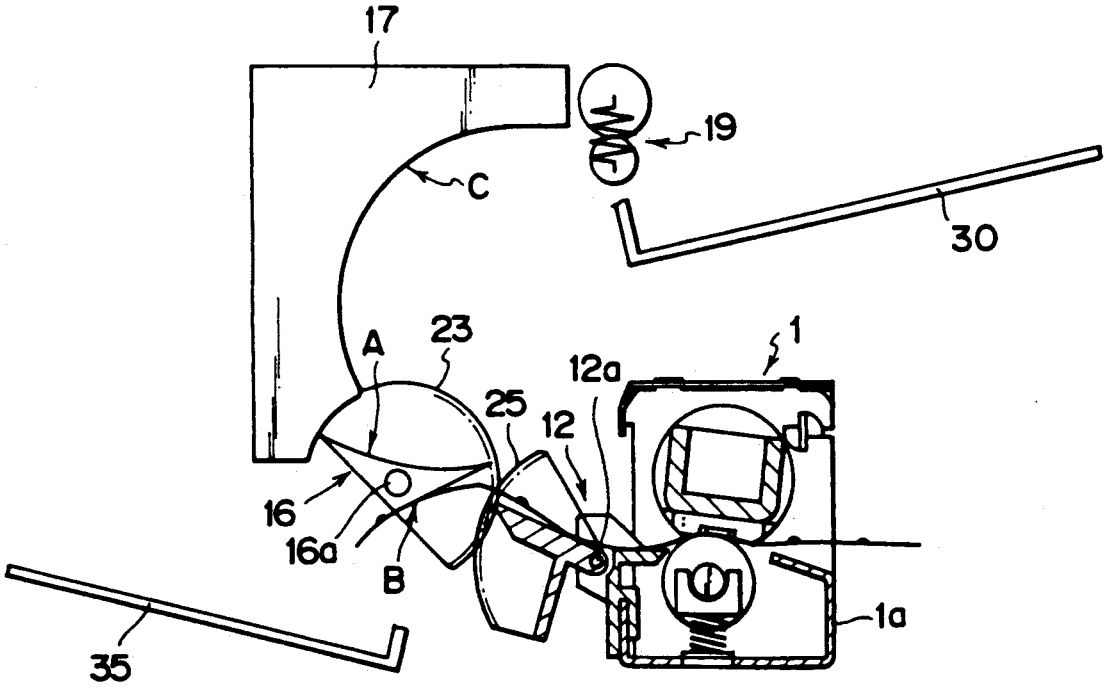
Figure 7:
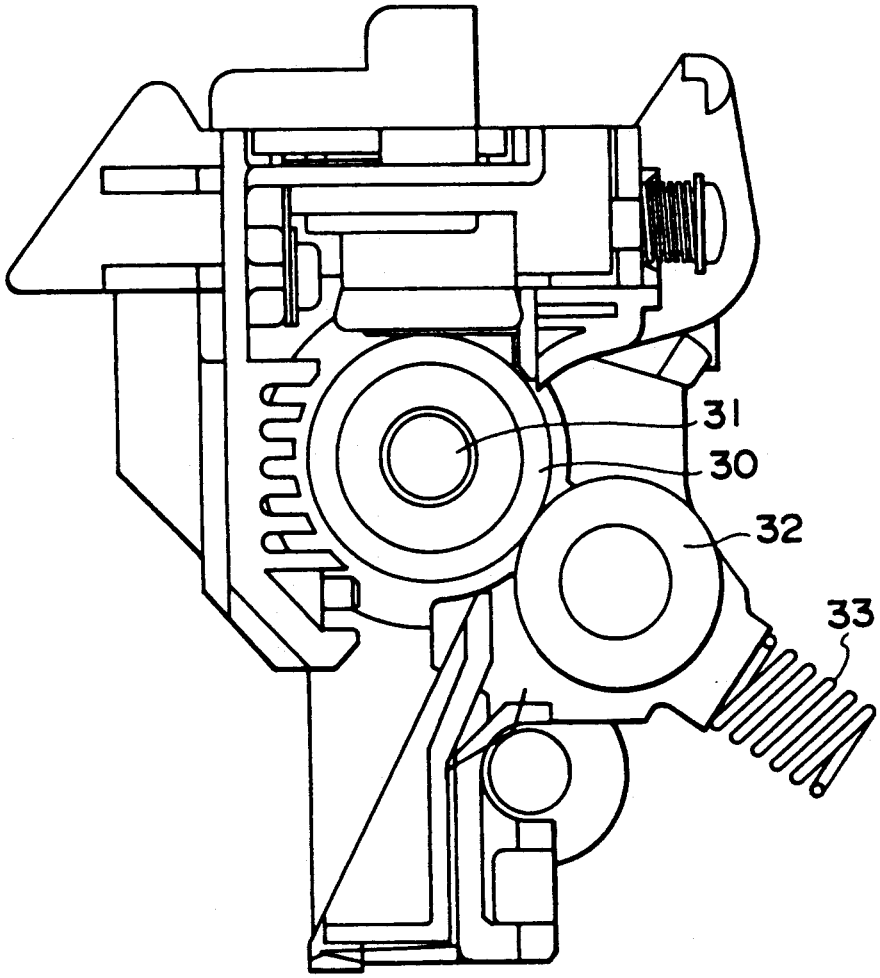
FIG. 7 PRIOR ART
FIG. 7 is an elevational sectional view of a conventional fixing device.
Figure 9:
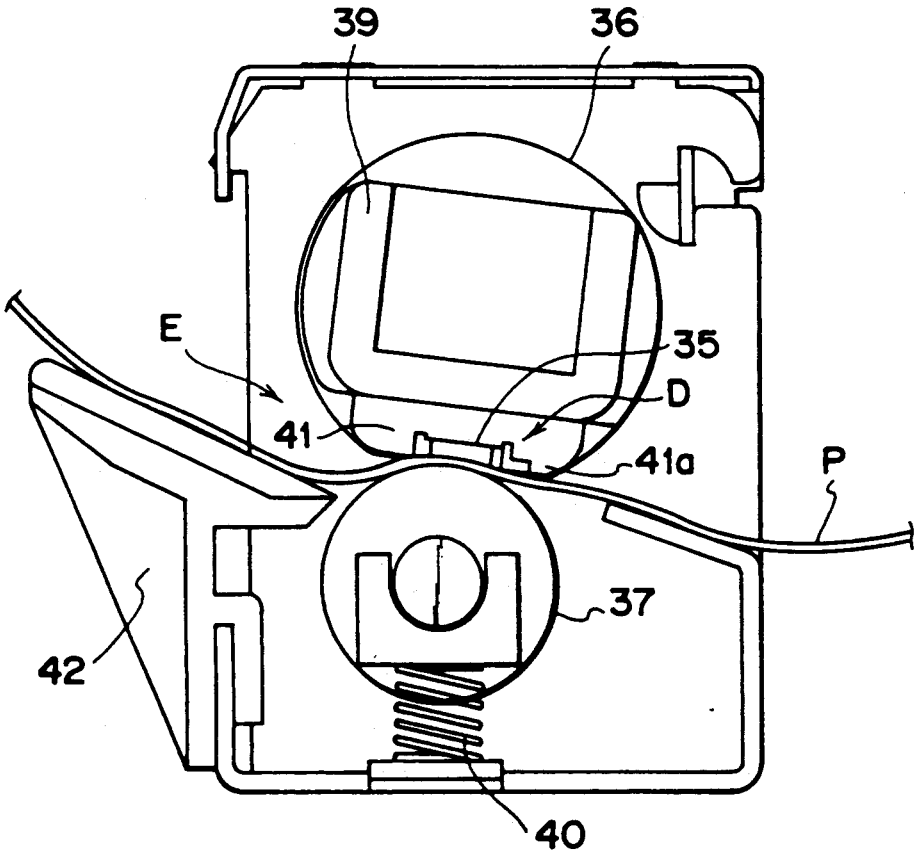
FIG. 9 PRIOR ART
FIG. 9 is an elevational sectional view of the fixing device of FIG. 8, showing a condition that a transfer sheet is curled.
Figure 8:
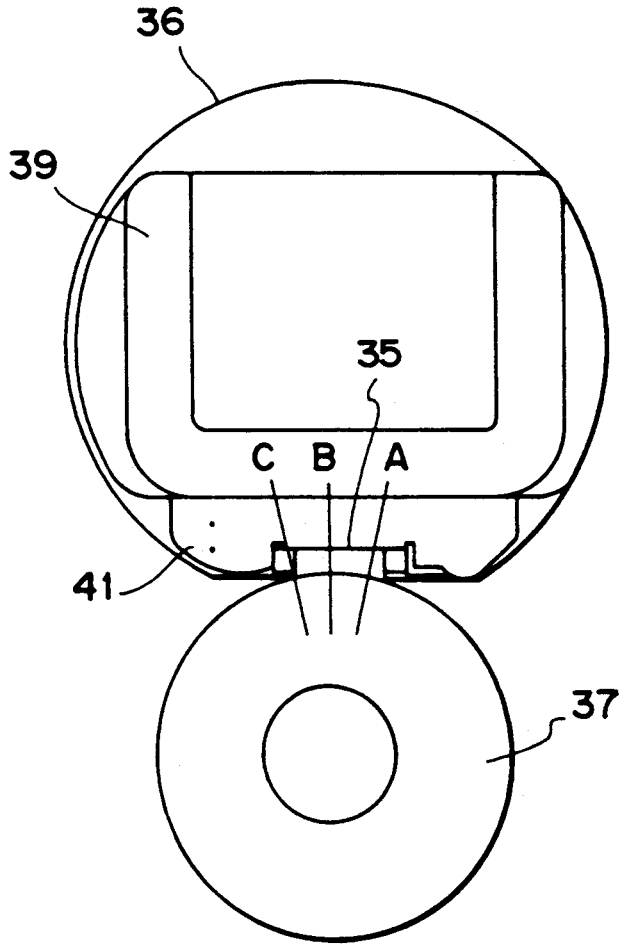
FIG. 8 PRIOR ART
FIG. 8 is an elevational sectional view of another conventional fixing device.
Figure 10:
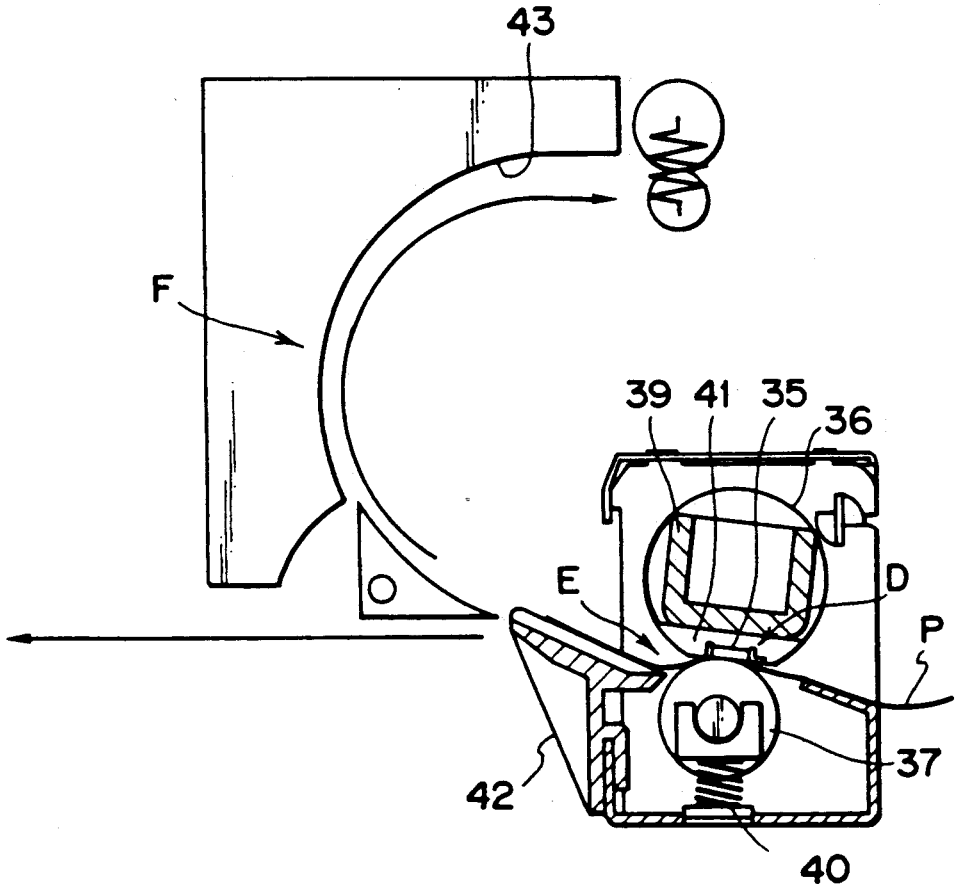
FIG. 10 PRIOR ART
FIG. 10 is an elevational sectional view showing a condition that the curl is corrected in a face-down sheet discharge path.

Next, a third embodiment of the present invention will be explained with reference to FIGS. 6A and 6B. In this embodiment, in place of the compression spring 15 and the stoppers 13, 16b shown in FIGS. 1 and 2, toothed segments 23, 25 are formed on the flapper 16 and the sheet discharge guide 12, respectively, which toothed segments 23, 25 are meshed with each other and can be rotated around the pivots 16a, 12a, respectively. The gear ratio between the toothed segments is selected so that the same rotations of the flapper and of the sheet discharge guide as those in the first and second embodiments are obtained.

Also with this arrangement, the same technical advantages as those of the above-mentioned first and second embodiments can be obtained.

In the first, second and third embodiments, while the present invention was explained regarding the fixing device 1 wherein the downwardly directed curl was generated in the sheet at the fixing nip, the present invention may be applied to a fixing device which comprises an upper pressure roller and a lower fixing roller and wherein a downwardly directed curl is generated in the sheet at a fixing nip. Further, the flapper 16 and the sheet discharge guide 12 may be interconnected via linkage and the like so that they are rotated in synchronous with each other. In addition, the fixing device may be of heat fixing type, pressure fixing type or heat/pressure fixing type.

What is claimed is:

1. A sheet discharging apparatus comprising curl generating means wherein a curl is generated in a sheet while the sheet is passing through said curl generating means, and first guide means disposed downstream of said curl generating means and switchingly movable between a first position where the sheet is directed toward a curved sheet path and a second position where the sheet is directed toward a direction which is the same as a sheet feeding direction from said curl generating means, characterized by that:

sheet discharge guide means is disposed between said curl generating means and said first guide means and switchingly movable in synchronism with the switching movement of said first guide means to change its posture, between a first position where the sheet discharged from said curl generating means is curled reversely and a second position where the sheet discharged from said curl generating means is not further curled.

2. A sheet discharging apparatus according to claim 1, further including means for driving said first guide means and said sheet discharge guide means associated with each other so that when said first guide means reaches said first position, said sheet discharge guide means is positioned to guide the sheet substantially in a horizontal direction, and when said first guide means reaches said second position said sheet discharge guide means is positioned to direct the sheet to said first guide means while bending the sheet.

3. A sheet discharging apparatus according to claim 2, further including a sheet discharge tray disposed downstream of said curved sheet path to receive the sheet in a face-down mode.

4. A sheet discharging apparatus according to claim 2, further including a sheet discharge tray for receiving the sheet discharged, in a condition that said first guide means is in said second position, in a face-up mode.

5. A sheet discharging apparatus according to claim 2, wherein said first guide means comprises a pivotable flapper.

6. A sheet discharging apparatus according to claim 5, wherein said sheet discharge guide means includes a guide surface pivotable in an up-and-down direction.

7. A sheet discharging apparatus according to claim 6, wherein said sheet discharge guide means is biased by spring means so that said guide surface is inclined upwardly, and said sheet discharge guide means is driven in synchronism with a pivotal movement of said flapper so that said guide surface becomes substantially horizontal when said first guide means reaches the first position.

8. A sheet discharging apparatus according to claim 6, wherein said sheet discharge guide means is held by its own weight so that said guide surface becomes substantially horizontal, and is lifted and held by the pivotal movement of said first guide means so that said guide surface is inclined upwardly.

9. A sheet discharging apparatus according to claim 2, wherein said first guide means and said sheet discharge guide means are interconnected by gears.

10. A sheet discharging apparatus comprising curl generating means wherein a curl is generated in a sheet while the sheet is passing through said curl generating means, and first guide means disposed downstream of said curl generating means and switchingly movable between a first position where the sheet is directed toward a curved sheet path and a second position where the sheet is directed toward a direction the same as a sheet feeding direction from said curl generating means, characterized by that:

sheet discharge guide means is disposed between said curl generating means and said first guide means and switchingly movable to change its posture between a position where the sheet discharged from said curl generating means is curled reversely and a position where the sheet discharged from said curl generating means is not further curled.

11. A sheet discharging apparatus according to claim 10, wherein said sheet discharge guide means takes a first posture for directing the sheet substantially in a horizontal direction and a second posture for curving or bending the sheet, and wherein said sheet discharge guide means takes said first posture when said first guide means is in said first position and takes said second posture when said first guide means is in said second position.

12. An image forming apparatus wherein a sheet fed from a curl generating means is selectively discharged onto a first sheet discharge tray or a second sheet discharge tray, comprising:

a first sheet feeding path including a first curved sheet path for directing the sheet to said first sheet discharge tray;

a second sheet feeding path including a second curved sheet path for directing the sheet to said second sheet discharge tray; and switching means for nullifying said second curved sheet path when said first sheet feeding path is selected and for forming said second curved sheet path when said second sheet feeding path is selected.

13. An image forming apparatus according to claim 12, wherein said first and second curved sheet paths serve to curve the sheet toward a direction opposite to a curled direction of the sheet.

14. An image forming apparatus wherein a sheet fed from curl generating means is discharged, comprising:

a first sheet feeding path disposed downstream of said curl generating means and including a first curved sheet path for directing the sheet;

a second sheet feeding path disposed downstream of said curl generating means and including a second curved sheet path for directing the sheet; and switching means for nullifying said second curved sheet path when said first sheet feeding path is selected and for forming said second curved sheet path when said second sheet feeding path is selected.

15. An image forming apparatus according to claim 14, wherein said first and second curved sheet paths serve to curve the sheet toward a direction opposite to a curled direction of the sheet.

16. An image forming apparatus wherein a sheet fed from a curl generating means is discharged, comprising:

a first sheet feeding path disposed downstream of said curl generating means and including first curl correcting means for directing the sheet;

a second sheet feeding path disposed downstream of said curl generating means and including a second curl correcting means for directing the sheet; and switching means for making said second curl correcting means inoperative when said first sheet feeding path is selected and for making said second curl correcting means operative when said second sheet feeding path is selected.

17. An image forming apparatus according to claim 16, wherein said curl generating means comprises fixing means, and said first and second curl correcting means comprise curved sheet paths.

18. An image forming apparatus with a sheet discharging apparatus comprising curl generating means wherein a curl is generated in a sheet while the sheet is passing through said curl generating means, and first guide means disposed downstream of said curl generating means and switchingly movable between a first position where the sheet is directed toward a curved sheet path and a second position where the sheet is directed toward a direction which is the same as a sheet feeding direction from said curl generating means, characterized by that:

sheet discharge guide means is disposed between said curl generating means and said first guide means and switchingly movable in synchronism with the switching movement of said first guide means to change its posture between a first position where the sheet discharged from said curl generating means is curled reversely and a second position where the sheet discharged from said curl generating means is not further curled.

* * * * *

UNITED STATES PATENT AND TRADEMARK OFFICE

CERTIFICATE OF CORRECTION

PATENT NO. 5,237,381

DATED August 17, 1993

INVENTOR(S) Tatsuo HAMADA

It is certified that error appears in the above-indentified patent and that said Letters Patent is hereby corrected as shown below:

On the Cover Page

[56] OTHER PUBLICATIONS, after "Abstract of Japanese Kokai Application 1-316777 Published Dec. 1989" insert --Abstract of Japanese Kokai Application 61-75369 Published Apr. 1986--.

Column 1

Line 29, "time" should read --time for--,
Line 30, "of" should be deleted,
Line 63, "donwstream" should read --downstream--.

Column 2

Line 38, "synchronous" should read --synchronism--,
Line 54, "syn-" should read --synchronism--,
Line 55, "chronous" should be deleted,
Line 62, "synchronous" should read --synchronism--,
Line 65, "synchronous" should read --synchronously--.

UNITED STATES PATENT AND TRADEMARK OFFICE

CERTIFICATE OF CORRECTION

PATENT NO. 5,237,381

DATED August 17, 1993

INVENTOR(S) Tatsuo HAMADA

It is certified that error appears in the above-indentified patent and that said Letters Patent is hereby corrected as shown below:

Column 3

Line 7, "synchronous" should read --synchronism--,
Line 11, "geneated" should read --generated--,
Line 14, "synchronous" should read --synchronism--,
Line 17, "synchronous" should read --synchronously--,
Line 21, "nous" should read --nism--.

Column 6

Line 16, "nous" should read --nism--.

Signed and Sealed this

Twelfth Day of April, 1994

Bruce Lehman

*Attest:*

BRUCE LEHMAN

*Attesting Officer*

*Commissioner of Patents and Trademarks*